United States Patent [19]

Blase et al.

[11] Patent Number: 4,910,828

[45] Date of Patent: Mar. 27, 1990

[54] CLEANING APPARATUS

[75] Inventors: Michael R. Blase; Henry J. Rosendall; Daniel L. Koltak; David E. McDowell, all of Grand Rapids, Mich.

[73] Assignee: Bissell Inc., Grand Rapids, Mich.

[21] Appl. No.: 214,013

[22] Filed: Jun. 30, 1988

[51] Int. Cl.[4] ..... A47L 7/00

[52] U.S. Cl. ..... 15/321; 15/322; 15/323; 15/352; 15/353

[58] Field of Search ..... 15/320, 321, 322, 323, 15/353, 352

[56] References Cited

U.S. PATENT DOCUMENTS

| | | | |
|---|---|---|---|
| 1,240,799 | 9/1917 | Gray | 15/320 |
| 1,498,556 | 6/1924 | Winchester . | |
| 1,929,345 | 10/1933 | Brown et al. | 15/321 |
| 2,049,603 | 8/1936 | Dietenberger | 15/323 X |
| 2,233,167 | 2/1941 | Holm-Hansen | 15/323 X |
| 2,531,370 | 11/1950 | Thompson | 15/371 X |
| 2,731,103 | 1/1956 | DeOrtega | 15/323 X |
| 2,913,755 | 11/1959 | Buccasio | 15/323 |
| 3,030,650 | 4/1962 | Kiraly | 15/323 X |
| 3,316,579 | 5/1967 | Smith | 15/320 |
| 3,574,239 | 4/1971 | Sollerud | 15/321 X |
| 3,594,849 | 7/1971 | Coshow | 15/321 |
| 3,687,729 | 8/1972 | Winburn et al. | 15/321 X |
| 3,705,437 | 12/1972 | Rukavina et al. | 15/322 X |
| 3,940,826 | 3/1976 | Phillips et al. | 15/320 |
| 4,137,599 | 2/1979 | Steyer | 15/321 |
| 4,156,952 | 6/1979 | Lynch | 15/322 X |
| 4,167,798 | 9/1979 | Klugl et al. | 15/320 |
| 4,194,262 | 3/1980 | Finley et al. | 15/321 |
| 4,314,385 | 2/1982 | Wimsatt et al. | 15/321 |
| 4,485,518 | 12/1984 | Kasper | 15/322 |
| 4,541,142 | 9/1985 | Pudwill | 15/323 |
| 4,559,667 | 12/1985 | Fitzwater | 15/322 X |
| 4,798,613 | 1/1989 | Hetherington et al. | 15/320 X |
| 4,800,613 | 1/1989 | Blase et al. | 15/410 X |

*Primary Examiner*—Chris K. Moore

*Attorney, Agent, or Firm*—Price, Heneveld, Cooper, DeWitt & Litton

[57] ABSTRACT

A cleaning apparatus which is of a compact construction to facilitate easy manipulation and portability includes a housing enclosing a fluid pump and a vacuum fan and mounting upon opposite sides a recovery tank and a stowage panel. The stowage panel is adapted to stow the flexible wand having a nozzle when not in use. Also, the high voltage motor driving the vacuum pump is adapted to also act as half of a transformer in order to pick off the lower voltage needed for the low voltage motor driving the fluid pump.

31 Claims, 7 Drawing Sheets

CLEANING APPARATUS

BACKGROUND OF THE INVENTION

The present invention pertains to cleaning devices, and in particular to a cleaning apparatus utilizing a wet cleaning system.

In the past, the cleaning of a stain or dirt from a floor surface, furniture, etc., especially one having a carpet or other fabric covering, has been accomplished by using a rather large apparatus provided with wheels, an upstanding handle with which to push and direct the apparatus, and a pump and vacuum arrangement by which a cleaning solution is applied and removed from the soiled surface. Such apparatus typically includes an assortment of accessories which convert the apparatus from a floor cleaning mode to an auxiliary mode for cleaning other items, such as furniture. These apparatuses operate by dispersing a cleaning solution onto the soiled surface, agitating the fabric surface and solution with a brush assembly, and continually removing the expended solution and dirt entrained therein from the cleaned surface. The dispensing of the cleaning solution is generally made intermittently by a manually actuated valve; and thus requires the fluid pump to possess a pressure sensing means and an automatic switch which acts to turn the pump on and off when the valve is opened and closed.

Although these apparatuses generally perform an adequate cleaning of the desired surface, they are large and unwieldy to operate. Due to their bulk and cumbersome configuration, they are extremely difficult to haul from one floor level to another via a staircase, or to transport from location to location. The need to attach accessories not only renders the cleaning of an item other than a floor surface very inconvenient, but also increases the storage requirements for the apparatus and the danger of losing a necessary part. The cost of such an apparatus is high due to a relatively large amount of materials needed and the need for a relatively expensive cleaning fluid pump arrangement having a pressure sensing means and automatic switch.

SUMMARY OF THE INVENTION

In accordance with the present invention, a cleaning apparatus including a cleaning solution dispenser, a fluid pump, a vacuum fan and a removable recovery tank are all cooperatively arranged in a housing in a unique compact design. The cleaning apparatus includes a hose having a hand tool which is adapted for easy use on any surface, regardless of whether it is a floor, furniture or other item which needs cleaning. Fluid is pumped to said hand tool and deposited on the surface to be cleaned, from whence it is drawn back through the vacuum hose and is deposited in the removable recovery tank.

By using the cleaning apparatus of the present invention, portability and manipulation thereof are greatly enhanced. The cleaning apparatus is easily transported to any location, even via a staircase, due to its small size and lightweight construction. These and other objects, advantages and features of the present invention will be more fully understood and appreciated by reference to the written specification and appended drawings.

DETAILED DESCRIPTION OF THE PREFERRED EMBODIMENTS

Figure 3:
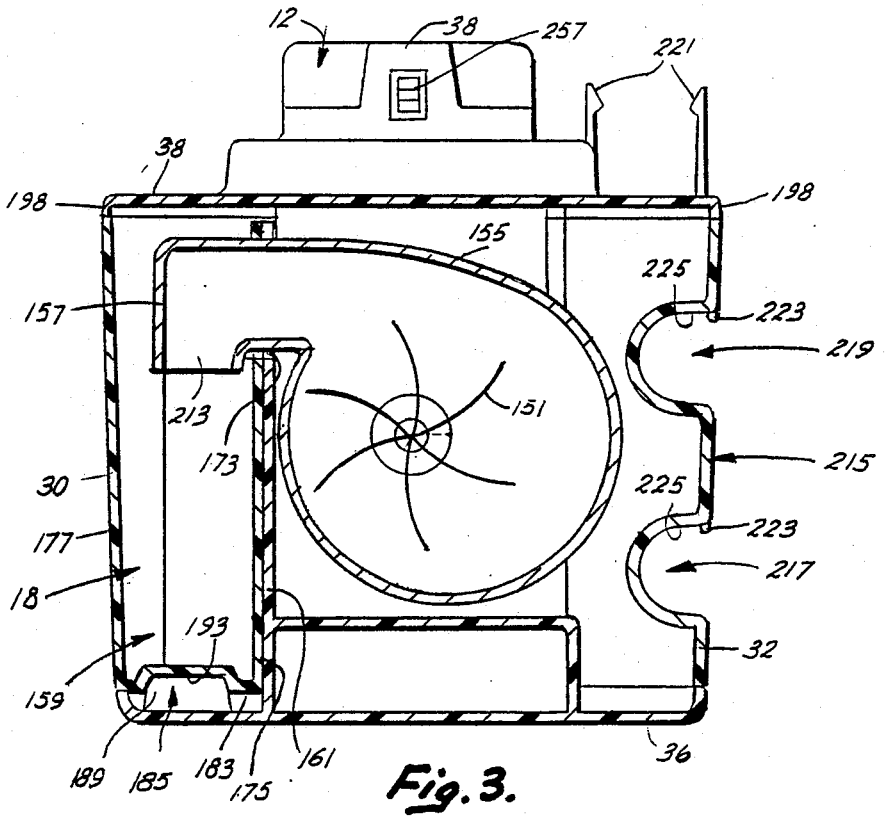
FIG. 3 is a cross-sectional view taken along lines III—III in FIG. 2.
Figure 4:
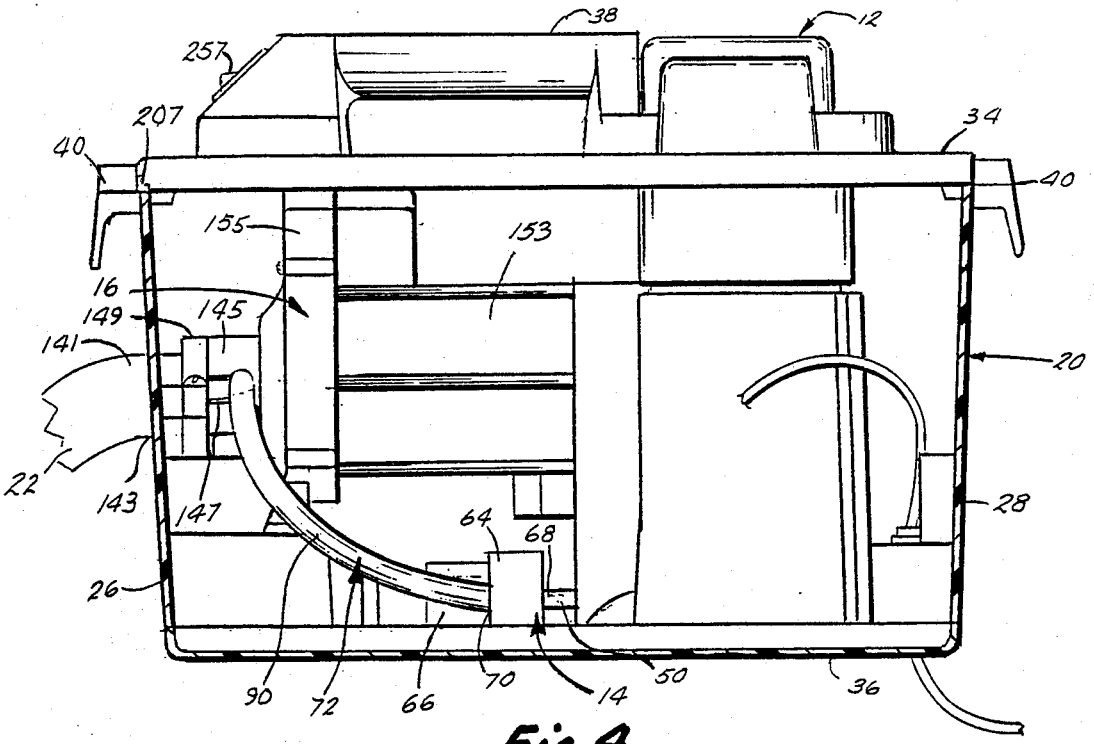
FIG. 4 is a cross-sectional view taken along lines IV—IV in FIG. 2.

In the preferred embodiment, cleaning apparatus 10 includes a supply tank or fluid dispenser 12 removably located within a receiving well 54 in housing 20 (FIGS. 1–4), a fluid pump 14 (FIG. 4), a vacuum fan 16 (FIG. 4) and a removable recovery tank 18 (FIG. 2) all positioned and arranged within a housing 20 in an efficient and compact manner. Pick up tool or hand tool 24 is connected to vacuum fan 16 by vacuum hose 22, and dispensing nozzle 78 in tool 24, through which the cleaning fluid is dispersed, is connected to fluid pump 14 through supply conduit 72 located within hose 22 (FIGS. 2 and 4).

Figure 1:
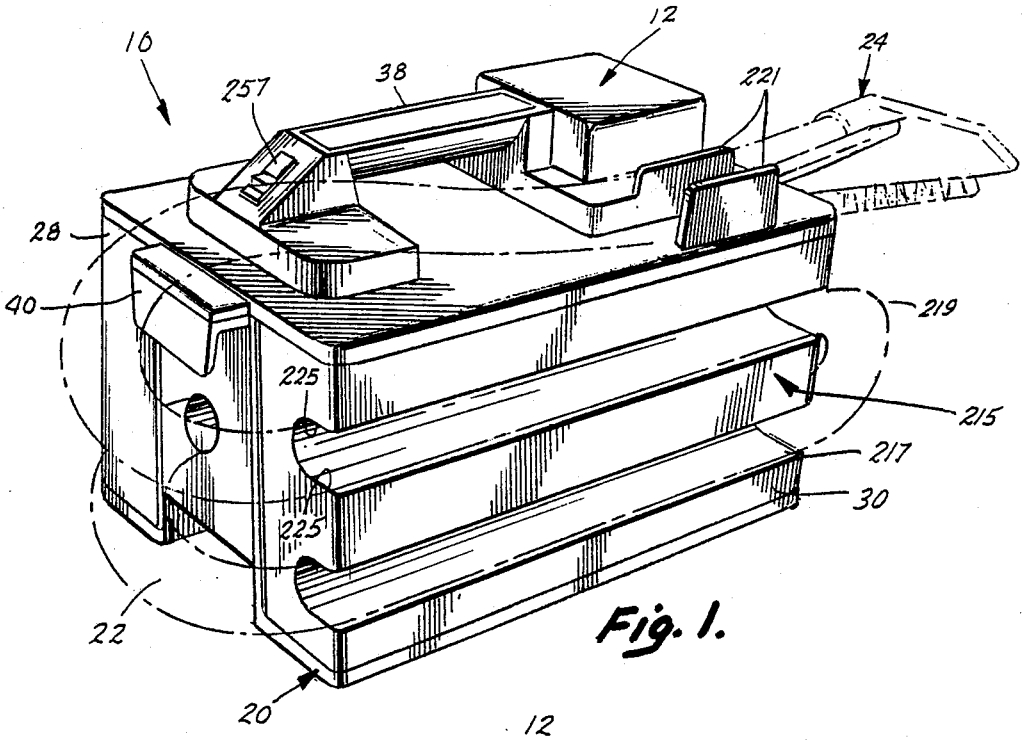
FIG. 1 is a perspective view of the cleaning apparatus of the present invention with its vacuum hose in a stored position.
Figure 2:
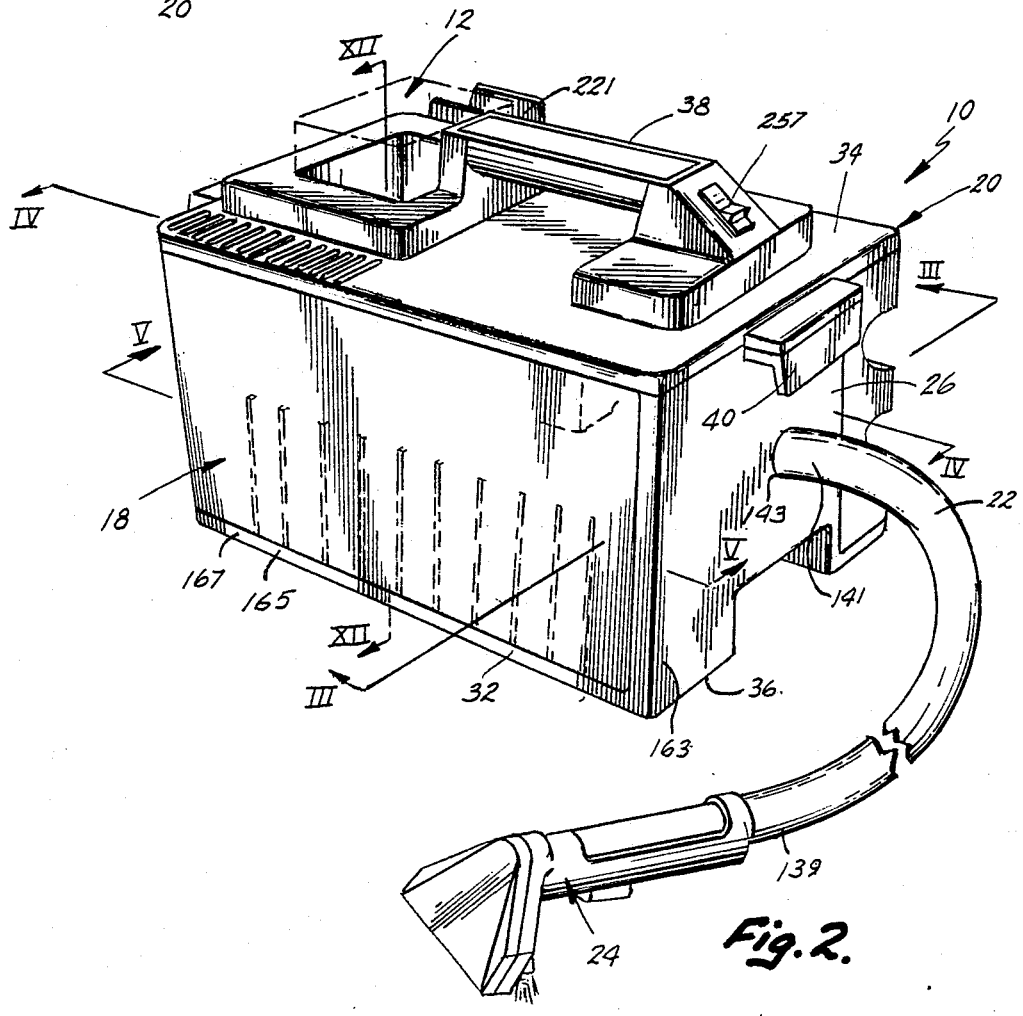
FIG. 2 is a perspective view of the cleaning apparatus with the hose and hand tool in an operating position.

Housing 20 is rectangular in configuration, including front and rear walls 26, 28, a pair of opposing sides 30, 32, a top 34 and a bottom 36 (FIGS. 1 and 2). To enhance the portability and manipulability of cleaning apparatus 10, top 34 is provided with an easily grasped hand grip 38 located centrally thereof. Cleaning apparatus 10 may be alternatively carried by a pair of auxiliary handles 40 having an L-shaped configuration and projecting outwardly along the top edges of the front and rear walls 26, 28.

Figure 12:
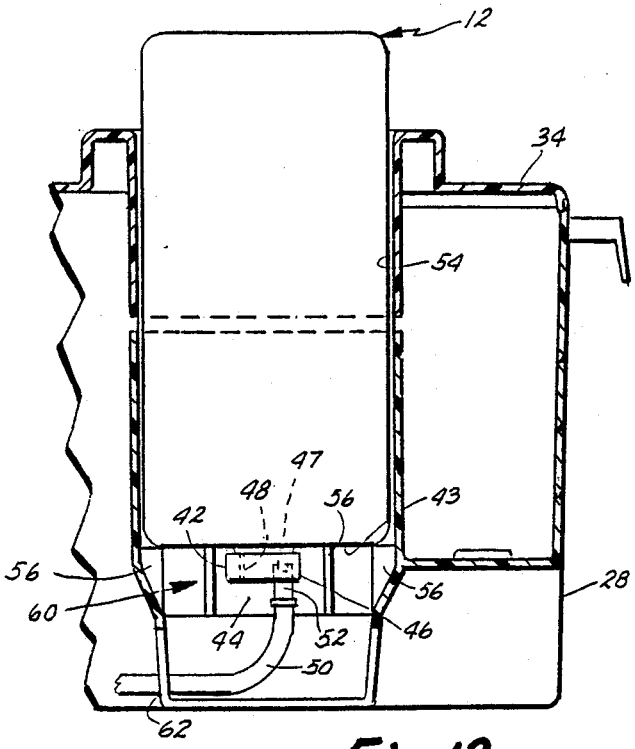
FIG. 12 is a fragmentary cross-sectional view taken along lines XII—XII in FIG. 2.

Supply tank 12 is a removable container or bottle which contains a cleaning solution (FIGS. 1, 2 and 12). It can be removed and replaced after it has been emptied.

Supply tank 12 is preferably an elongated rectangularly shaped container having a head 42 at one end 43. Head 42 is substantially cylindrical in shape (although any desired shape could be utilized), and includes along its distal surface a spout 46 and a small diameter vent opening 48. Spout 46 is provided to effect the coupling of supply tank 12 to hose 50 stationed within housing 20. In the most preferred embodiment, spout 46 is recessed within head 42 and circumscribed by a recess 47 into which a polymeric or rubber coupling 52 of hose 50 is inserted for connection with spout element 46. This construction, then, provides an easily-connectable coupling arrangement which is not susceptible to subsequent inadvertent disconnection. Vent opening 48 is provided to vent air into supply tank 12 during the operation of cleaning apparatus 10 when the cleaning solution is exiting supply tank 12. A tube inside dispensing supply tank 12 extends from passage 48 to the bottom (or top when inverted) thereof and a small ball check valve is located within passage 48 to prevent fluid flow therethrough.

In operation, supply tank 12 is received with head 42 projecting downwardly into a receiving well or socket 54 in housing 20, adjacent hand grip 38 in top 34 (FIG. 12). Receiving well 54 is of a shape to matingly receive supply tank 12 therein so that no rattling or disorientation occurs. Along the periphery of the lower portion of receiving well 54 are included a plurality of mounting flanges 56 which are adapted to engage head end 43 of supply tank 12 for secure positioning thereof. Mounting flanges 56 act to space supply tank 12 upwardly from the bottom wall 58 of well 54 to provide a space 60 which receives hose 50.

To facilitate easy set-up of cleaning apparatus 10, hose 50 is elongated and has a length which permits coupling 52 to be extended upwardly beyond top 34 and out of well 54. In this orientation, coupling 52 is easily inserted onto spout element 46. Once the connection has been accomplished, supply tank 12 is inserted with its head 42 down into socket 54 as discussed above. No leakage of the cleaning solution occurs from supply tank 12 due to the fluid-tight connection effected by coupling 52 and spout element 46, and the small diameter of vent opening 48.

Hose 50 exits through an opening 62 in a side of well 54 and connects with a conventional, inexpensive fluid pump 14 (FIG. 4). More specifically, fluid pump 14 includes a small impeller (not shown) in casing 64 which is preferably powered by a small low voltage DC motor 66. Casing 64 includes an inlet port 68 on one end thereof which facilitates connection with hose 50 and on its other end, laterally spaced therefrom, an exit port 70 which facilitates connection with a supply conduit 72.

Figure 9:
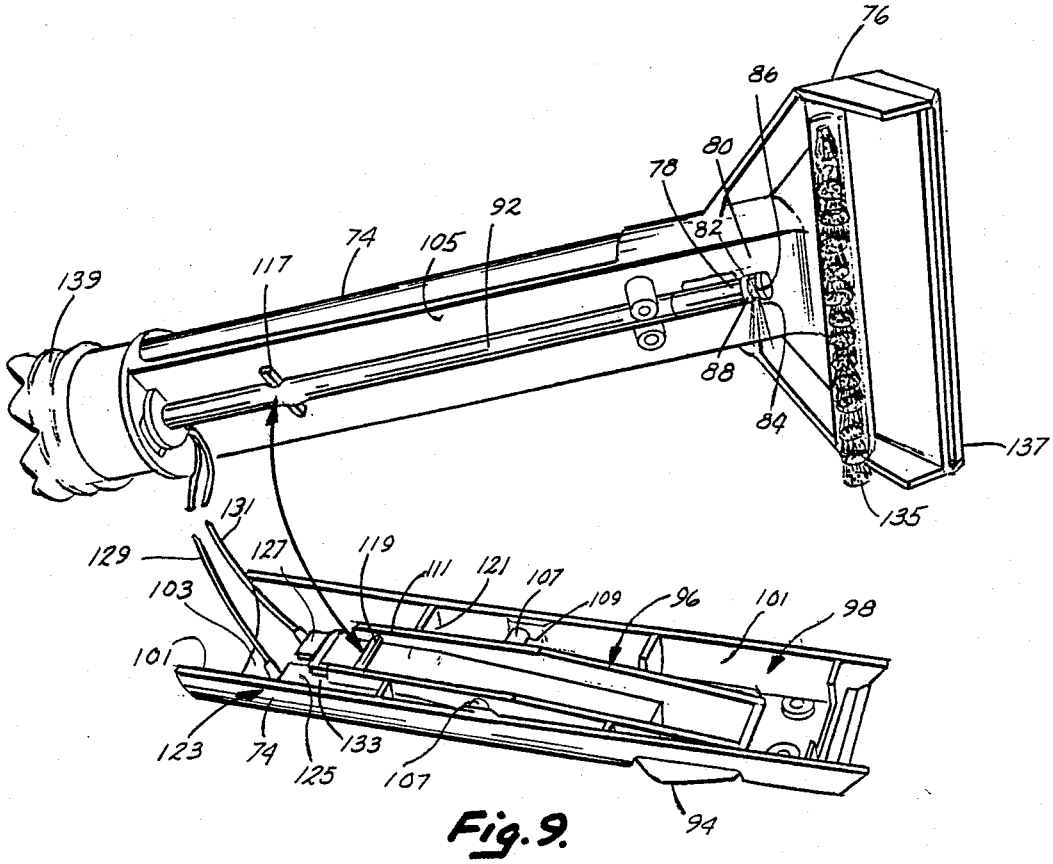
FIG. 9 is an exploded view of the end of the wand.
Figure 10:
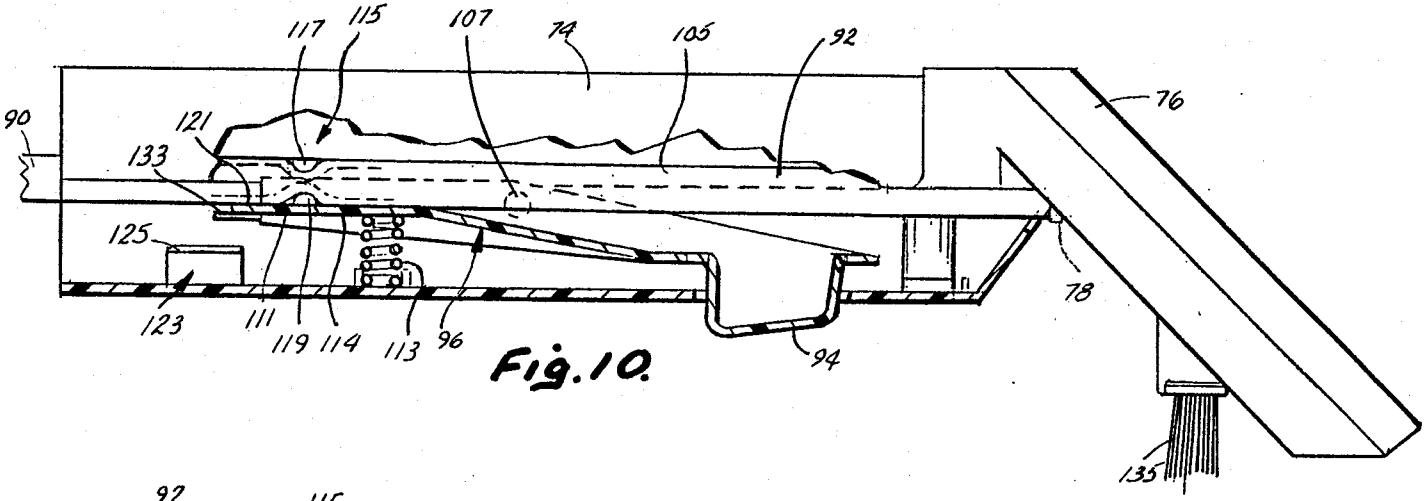
FIG. 10 is a side elevational view, partially broken away, of the end of the wand of the cleaning apparatus in an unactuated position.
Figure 11:
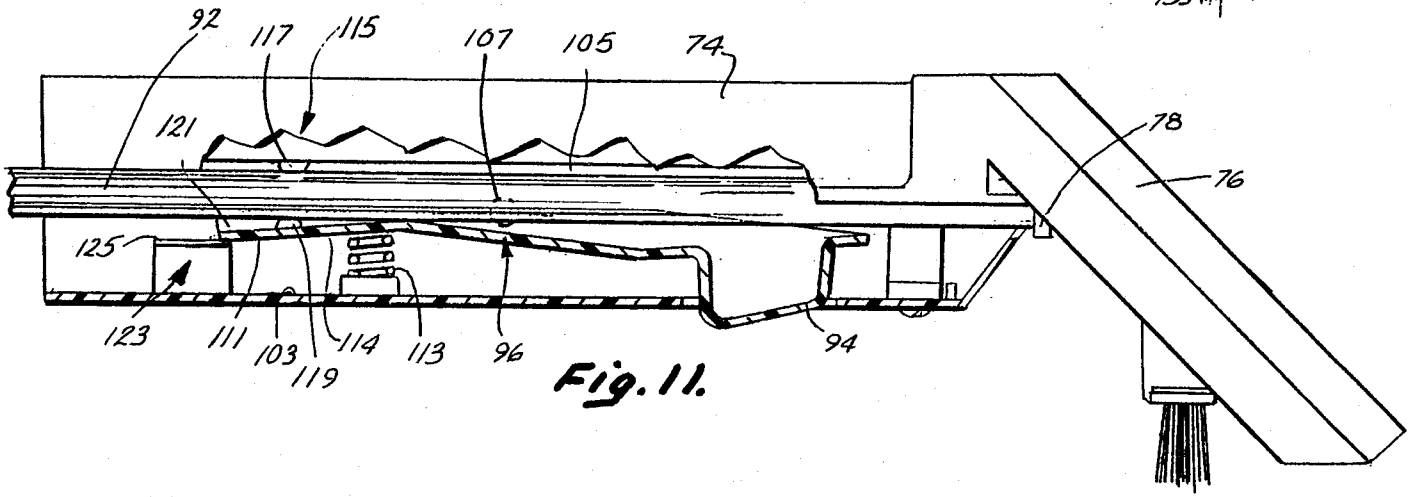
FIG. 11 is a side elevational view, partially broken away, of the end of the wand in an actuated position.

Supply conduit 72 is utilized to disperse the cleaning solution onto the soiled or stained surface for cleaning purposes. To effect this operation, supply conduit 72 is received within vacuum hose 22 and extends therethrough the entire length until reaching dispensing nozzle 78 located in the wand or hand tool 24 (FIGS. 9–11). Hand tool 24 includes a rigid shank segment 74 and an enlarged head 76. Supply conduit 72 extends under shank segment 74 to dispersing nozzle 78 attached to the end thereof. Dispersing nozzle 78 includes a channel-shaped recess 80 having a pair of gradually sloping sidewalls 82, 84 and an interconnecting bight portion 86 (FIG. 9). Sidewall 82 is provided with a small orifice 88 fluidly coupled with supply conduit 72 to provide an exit passage through which the cleaning solution is dispersed. When the cleaning solution passes through orifice 88 it engages sidewall 84 so that the flow thereof is broken up to disperse the cleaning solution along a wide swath of the soiled surface.

Preferably, supply conduit 72 is comprised of a passage segment 90 and a control segment 92 (FIGS. 4 and 9–11). Passage segment 90 is composed of a flexible but relatively non-collapsible material, such as vinyl tubing; and extends from fluid pump 14, through housing 20 and hose 22, to shank 74 of hand tool 24. At this juncture, passage segment 90 couples with a control segment 92 which is composed of a soft pliable material, such as a silicone rubber, which can be more easily closed by pinching, as will be discussed below. Alternatively, supply conduit 72 may be of a single unitary material if desired, but must then be of the softer, more pliable material.

To control the flow of fluid through supply conduit 72 and onto the surface to be cleaned, shank segment 74 of hand tool 24 is provided with a manually actuated control button 94 (FIGS. 9–11). Control button 94 is integrally formed with a lever 96 received within a cavity 98 formed within shank 74. Cavity 98 is defined by a pair of inner sidewalls 101, a lower wall 103 through which control button 94 is received, and an upper wall 105 along which control segment 92 of supply conduit 72 is mounted.

Lever 96 is pivotally mounted within cavity 98 by a pair of oppositely projecting stub axles 107 fixedly attached to a medial portion thereof (FIGS. 9–11). Axles 107 are received within a corresponding pair of openings 109 provided in inner sidewalls 101. The second end 111 of lever 96 is adapted to cooperate with a coil spring 113. Coil spring 113 is positioned between lower wall 103 of shank 74 and second end 111 of lever 96 to thereby bias second end 111 toward upper wall 105. This biasing force of coil spring 114, then, pivots lever 96 about axles 107 such that control button 94 normally projects significantly outwardly beyond shank 74.

The control of dispersing the cleaning fluid is achieved through a pinch-off valve assembly 115 (FIGS. 9–11). Pinch-off valve assembly 115 includes a stationary ridge 117 extending laterally across upper wall 105 in a contiguous overlying relation with control segment 92 of supply conduit 72. Opposite thereof is a pinching ridge 119 fixedly attached to the upper surface 121 of the second end of lever 96. In the normally closed position (FIG. 10), coil spring 113 effects an upwardly biasing force on second end 111 of lever 96 so that pinching ridge 119 is forced against stationary ridge 117 to thereby pinch and close control segment 92 of supply conduit 72. In this position, the cleaning solution is effectively barred from traveling to dispersing head 78 for dispersion upon the surface to be cleaned. To permit passage of the solution therethrough, the operator presses control button 94 to pivotally rotate lever 96 about axles 107 so that second end 111 moves downwardly against the bias of coil spring 113 toward lower wall 103 of shank 74. This moves pinching ridge 119 away from stationary ridge 117 so that the pliable control segment 92 may once again expand and permit passage of the cleaning solution therethrough.

The use of pinch-off valve assembly 115 facilitates use of a relatively inexpensive, low voltage fluid pump 14 to pump cleaning fluid through supply conduit 72. Without pinch-off valve assembly 115, a more expensive positive shut-off pump would have to be used to prevent the continued siphoning of cleaning fluid. The low voltage aspects are important since this enables one to pass electrical wires for controlling pump 14 through hose 22 without violating electrical codes.

Fluid pump 14 is turned on and off by movement of button 94 and lever 96. A pair of laterally spaced apart contacts 125, 127 are mounted to lower wall 103 of shank 74 (FIG. 9). Contacts 125, 127 are electrically connected by a pair of tandem wires 129, 131 to fluid pump 14. Wires 129, 131 are insulated in a conventional manner and extend through hose 22 in the same manner as supply conduit 72. Second end 111 of lever 96 includes an electrical contact bridge 133 secured to the lower surface 114 of lever 96. Contact bridge 133 is designed to engage both contacts 125, 127 when control button 94 is pressed inwardly by the operator, and to be disengaged from contacts 125, 127 in the normally closed position effected by the biasing force of coil spring 113.

In operation, then, the pushing of control button 94 not only releases the pinched valve arrangement and opens supply conduit 72, but also effectuates the coordinating activation of fluid pump 14 so that the fluid is dispersed in a uniform manner out dispersing nozzle 78. Similarly, when control button 94 is released, coil spring 113 rotates lever 96 such that the contact between contact bridge 133 and contacts 125, 127 is broken to deactivate fluid pump 14 and pinching ridge 119 and stationary ridge 117 are once again forced together to pinch off and close supply conduit 72. The pinch-off valve arrangement 115 is needed in addition to the deactivation of fluid pump 14 to ensure that no cleaning fluid inadvertently exits dispersing nozzle 78 by the force of gravity.

Once the cleaning solution has been dispersed upon the soiled surface, it is desirous to agitate the fabric and the cleaning solution so that the dirt to be removed is effectively entrained within the solution. To accomplish this purpose, hand tool head 76 is provided with an elongated brush assembly 135 which preferably extends laterally across the width thereof. In use, the operator would generally grasp the shank segment 74 and move head 76 across the surface to work the cleaning solution into the fabric surface.

Forwardly of brush assembly 135 head 76 further includes a narrow slit 137 at its distal end. Slit 137 communicates with a passage (not shown) through shank 74 with hose 22. The passage defined thereby is coupled with vacuum fan 16 to effect the removal of the cleaning fluid and dirt entrained therein from the surface being cleaned.

Hose 22 is of a corrugated flexible configuration such as is conventional in some vacuum cleaners. Hose 22 includes a distal end 139 which couples to shank 74 of hand tool 24 and a proximate end 141 which is received through an opening 143 in front wall 26 of housing 20 to be effectively coupled with fluid port 145 of vacuum fan 16.

As discussed above, wires 129, 131 and supply conduit 72 are passed through the interior of hose 22 from housing 20 to hand tool 24. This construction is facilitated by providing a shallow indentation 147 in the otherwise circular fluid port 145 (FIG. 4). More specifically, the proximate end 141 of hose 22 is matingly received around the periphery 149 of fluid port 145 to thereby create a sufficient vacuum through hose 22. Indentation 147 snugly receives both the supply conduit 72 and tandem wires 129, 131 therein such that they may be then passed into wand 22 and travel therethrough to hand tool 24.

Vacuum fan 16 includes an impeller 151 (schematically shown in FIG. 3) driven by a conventional 120-volt AC motor 153 (FIG. 4). Impeller 151 is enclosed within a scroll casing 155 which is fluidly connected on its forward end to fluid port 145 (FIG. 4). Along its top portion, casing 155 also includes an exit spout 157 through which the expended cleaning fluid is passed for depositing within recovery tank 18 (FIG. 3). By positioning the vacuum pump upstream from recovery tank 18, recovery tank 18 need not be of an airtight configuration, which further increases the economical expediency of the present cleaning apparatus 10.

Recovery tank 18 (FIGS. 5–7) has a substantially elongate, narrow, rectangular configuration and is adapted to be matingly received within a side pocket 159 formed along side 32 of housing 20 (FIG. 2). More specifically, side pocket 159 is formed by a vertical interior wall 161 which extends substantially parallel to sides 30, 32 of housing 20, an end wall 163 defined by a portion of front wall 26, a low border wall 165 having an elongate longitudinal section 167 in spaced parallel relation to interior wall 161 and a short lateral section 169 in substantial alignment with rear wall 28, and a base surface 171 adapted to underlie recovery tank 18 when assembled in housing 20. Interior wall 161 further includes a notch 173 which receives therethrough exit spout 157 of vacuum pump 16 to facilitate the depositing of the expended cleaning solution within recovery tank 18.

Figure 5:
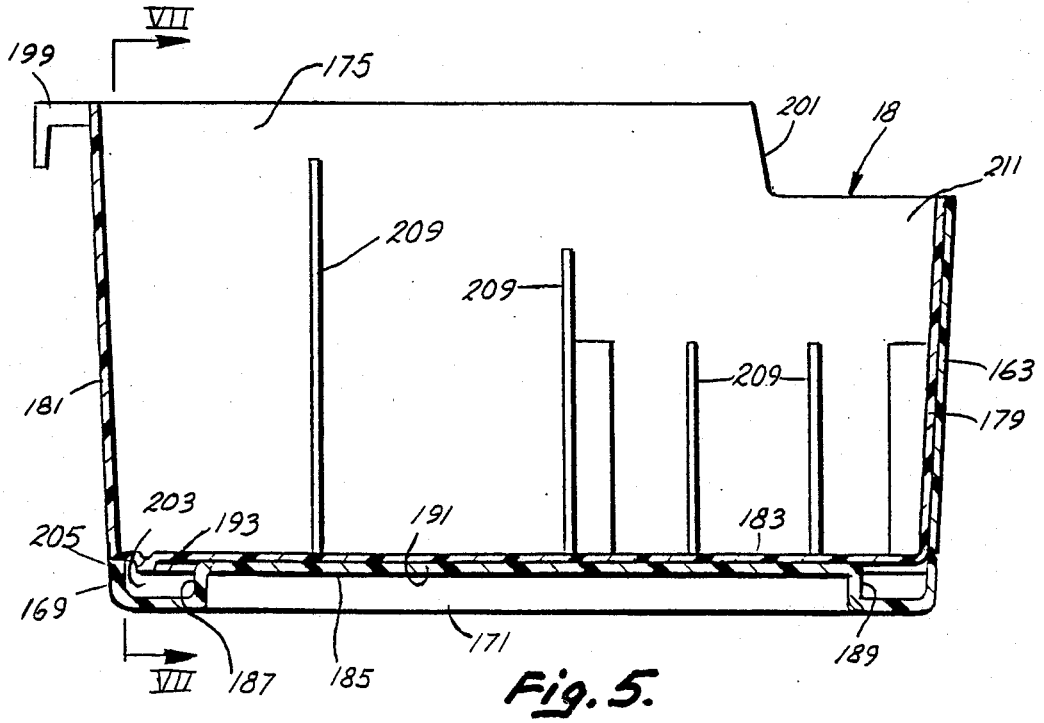
FIG. 5 is a cross-sectional view taken along lines V—V in FIG. 2.
Figure 6:
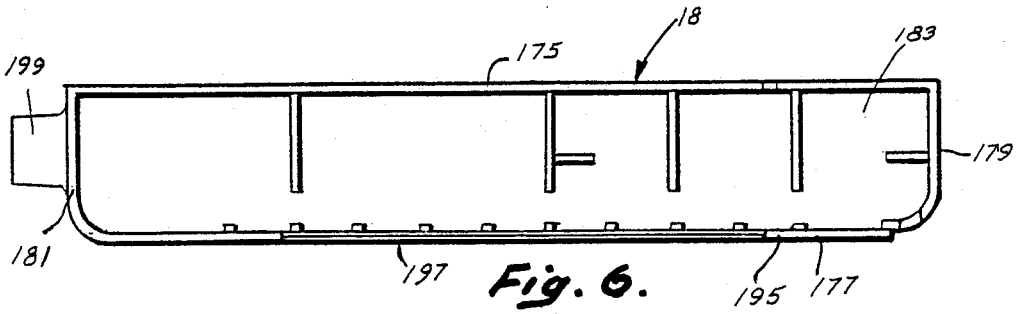
FIG. 6 is a top plan view of the recovery tank of the cleaning apparatus.
Figure 7:
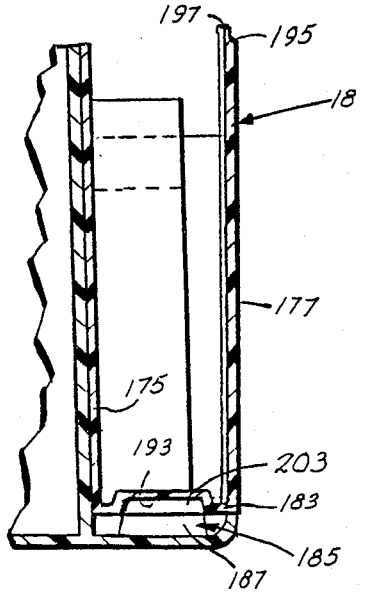
FIG. 7 is a fragmentary cross-sectional view taken along lines VII—VII in FIG. 5.

Recovery tank 18 is substantially shaped as an open-topped box having an inner wall 175, an outer wall 177, front and rear end walls 179, 181, and a bottom wall 183 (FIGS. 5–7). Recovery tank 18 is adapted to be releasably mounted in housing 20 so that it may slide rearwardly out of pocket 159 over the lateral section 169 of border wall 165. More specifically, when inserting recovery tank 18 into pocket 159, front end wall 179 is moved therein between lateral section 169 of border wall 165 and a portion of top 34 of housing 20.

Pocket 159 includes an upraised guideway 185 positioned longitudinally along base surface 171 and including a rearward end face 187 (opposing border wall 165) and a forward end face 189 (opposing end wall segment 163). Complementary to guideway 185, bottom wall 183 along its lower surface 191 includes a shallow channel 193 having a width substantially equal to the width of guideway 185 for mating receipt thereof. Also, to further ensure proper positioning of recovery tank 18, the upper edge 195 of outer wall 177 is provided with an upstanding lip 197 which is oriented in contiguous relation with the inner flange formed by a marginal rim 198 surrounding top 34 of housing 20.

To facilitate easy handling of recovery tank 18, the upper end of rearward end wall 181 is provided with a substantially L-shaped handle 199 (FIGS. 5 and 6). Of course, other grasping arrangements could be utilized. Also, to facilitate its insertion within side pocket 159, front end wall 179 and inner wall 175 are provided with a cut-out 201 in the upper forward portions thereof. Cut-out 201 provides ample clearance for the projecting exit spout 157 of vacuum pump 16.

To releasably hold recovery tank 18 within side pocket 159, channel 193 includes a ridge 203 extending laterally thereacross adjacent rear end wall 181 (FIGS. 5 and 7). Ridge 203 is adapted to cooperate with an upraised flange 205 on lateral section 169 of border wall 165 to thereby abuttingly engage one another and prevent the inadvertent rearward sliding of recovery tank 18. This becomes increasingly more effective as the cleaning solution is deposited into recovery tank 18, since this increases the downward force generated through bottom wall 183 due to the additional weight. Nevertheless, the marginal rim 198 on top 34 is provided with a slight gap 207 which permits the user to lift ridge 203 over upraised flange 205 when removing recovery tank 18.

Due to the substantial amount of cleaning fluid which may be deposited within recovery tank 18, a plurality of spaced apart lateral vanes 209 are positioned to extend partially across the width of recovery tank 18. These vanes 209 function to prevent the generation of any substantial wave action which may occur when removing tank 18. This construction, then, in turn alleviates the danger of splashing and spilling the expended cleaning solution. Also, a plastic foam member 211 is preferably provided over a pair of the forward vanes 209, directly beneath the opening 213 of exit spout 157 in order to eliminate the problem of foaming as the cleaning solution is deposited within recovery tank 18.

In operation, then, recovery tank 18 is properly fitted within side pocket 159 and the hose 22 is extended as shown in FIG. 2. Hose 50 is then coupled to the spout element 46 on supply tank 12, and supply tank 12 is matingly received into socket 54 with the head 42 directed downwardly as discussed above (FIG. 12). The operator thereafter grasps shank 74 of hand tool 24 and pushes control button 94 when the hand tool head 76 is positioned over the area to be cleaned. The pressing of control button 94 opens supply conduit 72 and activates fluid pump 14 such that the cleaning solution passes out of supply tank 12 into hose 50 through fluid pump 14, into supply conduit 72 and out dispersion nozzle 78 to be applied to the soiled surface. The operator then moves hand tool 24 such that brush assembly 135 agitates the soiled surface and cleaning solution. Also, since vacuum fan 16 continually runs, the cleaning solution having the dirt entrained therein is sucked into hand tool 24 through slit 137. The expended cleaning solution is then passed through hose 22 and into casing 155 through the force caused by impeller 151. The impeller 151 forces the fluid out exit spout 157 and into recovery tank 18. Once the cleaning operation is finished, vacuum fan 16 is turned off and recovery tank 18 is removed for disposal of the expended cleaning solution.

Figure 8:
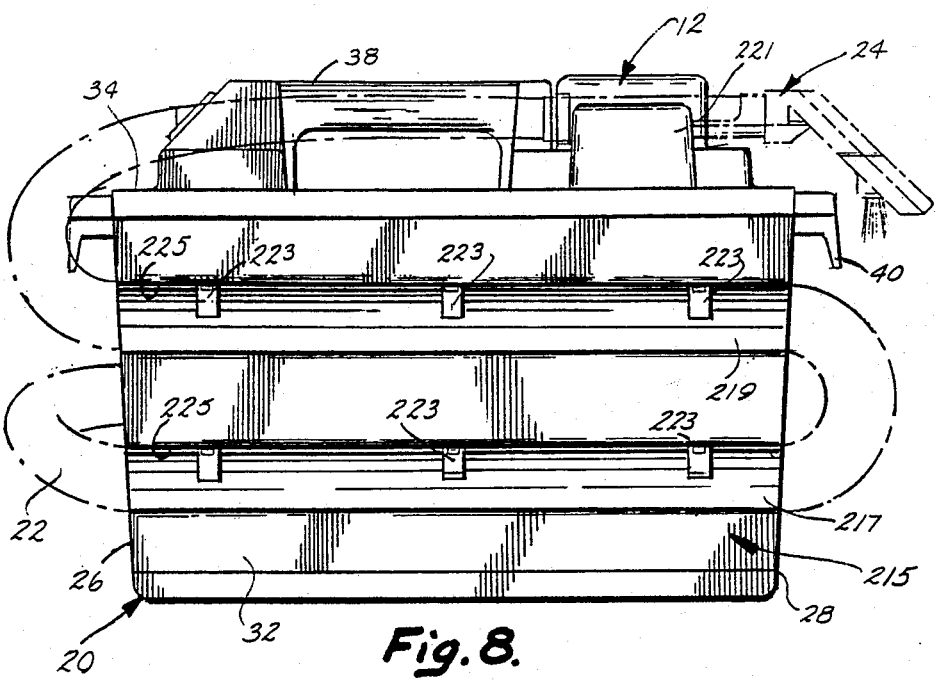
FIG. 8 is a side elevational view of the cleaning apparatus.

To further enhance the convenience and portability of cleaning apparatus 10, side 30 of housing 20 is provided with a stowage panel 215 (FIGS. 1, 3 and 8). Stowage panel 215 includes a pair of parallel recesses 217, 219 which are open at the opposite ends formed in the front and rear walls 26, 28 of housing 20. Recesses 217, 219 provide elongated stowage paths through which the pliable hose 22 may be fed in a serpentine manner for stowing. Furthermore, along top 34 of housing 20 are also provided a pair of mounting flanges 221 which are adapted to receive and mount therein the distal end 139 of hose 22. Mounting flanges 221 may snugly grip therebetween either the pliable corrugated wand portion 22 or the rigid shank 74.

To ensure that wound hose 22 will remain within stowage recesses 217, 219 until ready for use, a plurality of retaining knobs 223 project downwardly into recesses 217, 219 to act as a stop for wand 22 (FIGS. 3 and 8). More specifically, knobs 223 are spaced just inwardly of side 30 of housing 20 along the upper face 225 of each of the recesses 217, 219. Hence, knobs 223 will function to effectively retain hose 22 within recesses 217, 219, and still permit easy release thereof due to the inherent pliable nature of hose 22.

Figure 16:
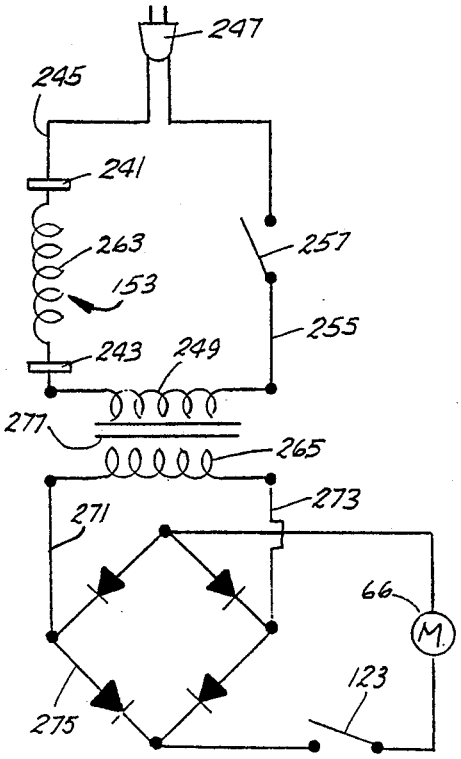
FIG. 16 is a schematic view of a first embodiment of the circuitry.
Figure 14:
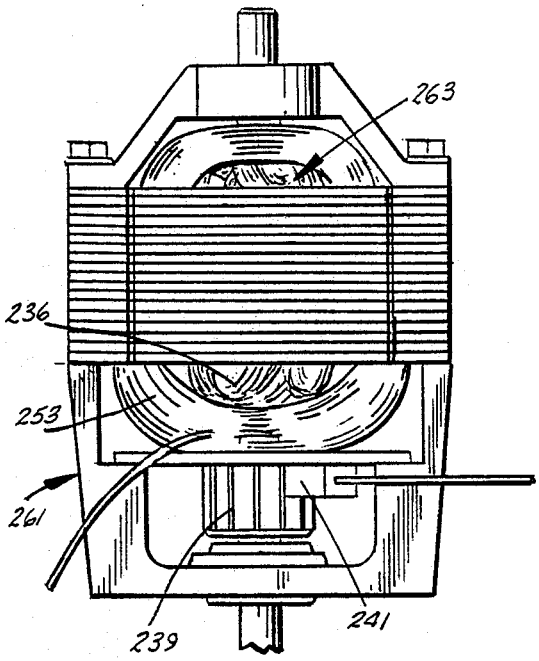
FIG. 14 is a front elevational view of the vacuum motor.
Figure 15:
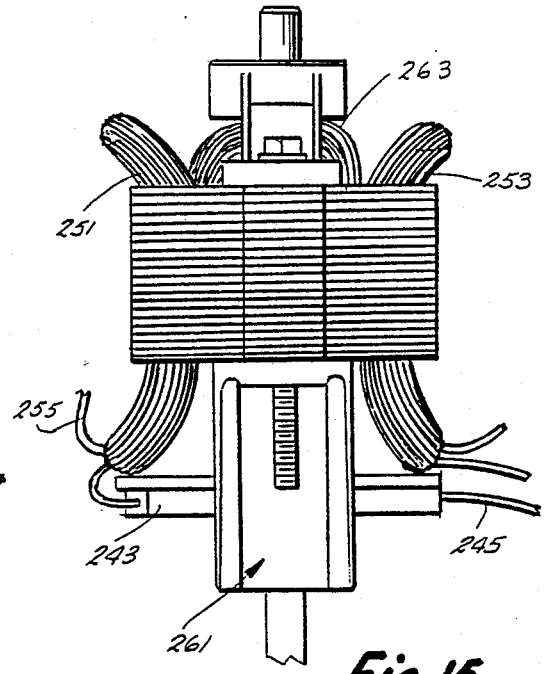
FIG. 15 is a side elevational view of the vacuum motor.
Figure 13:
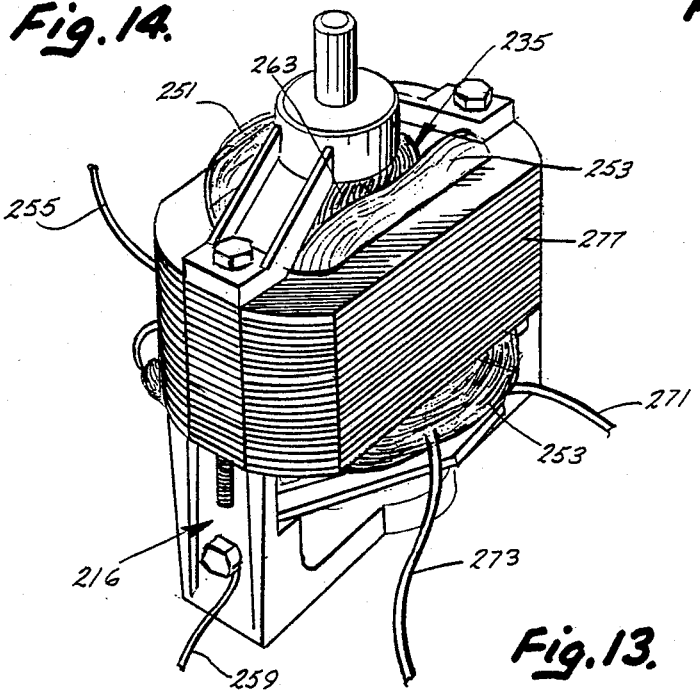
FIG. 13 is a perspective view of a vacuum motor of the cleaning apparatus.

Vacuum fan 16 is powered by 120-volt AC synchronous motor 153 (FIGS. 13–15). Motor 153 includes a central rotor 235 having an armature winding 263 and a commutator 239. Engaging commutator 239 in spaced apart locations are a pair of brushes 241, 243 (FIGS. 14 and 16). One brush 241 is connected to line 245 which runs from plug 247 which is adapted for insertion into a typical wall socket having 120-volt, 60 Hz electrical power. The opposing brush 243 is connected to a stator coil 251. In turn, stator coil 251 is coupled with line 255 which forms the complementary line coupled to plug 247. Positioned intermediately along line 255 is a main switch 257, preferably located in handgrip 38 (FIGS. 1 and 2), for turning the cleaning apparatus on or off. Also, as is conventional, a ground wire (not shown) coming from plug 247 is attached to the motor chassis 261 (FIG. 13). In operation, then, current flows through line 245 to brushes 241, wherein the contact between the brushes 241 and commutators 239 permit the current to flow through the armature windings 263. From the armature windings 263, the current flows back through commutators 239 to brushes 243. Brushes 243 are connected to the stator coil 251 which conveys the current to line 255, wherein it returns to plug 247 through main switch 257.

Motor 153 is, in a first embodiment, also adapted to function as half of a transformer in order to supply power to the low voltage DC motor 66 used to drive fluid pump 14. In a normal motor, there are two stator windings which create the magnetic field. In the present arrangement, stator coil 251 provides the magnetic field and also acts as a primary transformer coil to induce a voltage in a separate independent coil 253 which serves as the secondary coil of the transformer. Secondary coil 253 is connected at its two ends to lines 271, 273, respectively. Lines 271, 273 are connected to a diode bridge or rectifier 275 which converts the AC current into DC current for the low voltage DC motor 66.

The laminated base 277 fixedly attached to motor chassis 61 about the periphery of armature 263 functions as the core of the transformer. In this manner, the lower voltage needed to drive the DC motor is induced by the 120-volt AC vacuum motor. This enables the elimination of a separate, conventional transformer and thereby further enhances the economical savings to be realized by the manufacturer. Moreover, this utilization of the transformer concept accomplishes the obviating of the separate transformer in a manner acceptable to "UL" standards. In contrast, directly tapping off the stator coil windings at selected points in order to obtain the lower voltage is not approved, due to the danger of passing 110-volt line voltage to the low voltage DC motor in the case of a short.

Motors 66, 153 may, of course, in an alternate embodiment, be driven by a system utilizing a separate transformer.

Of course, it is understood that the above descriptions are those of preferred embodiments of the invention. Various other embodiments, as well as many changes and alterations, may be made without departing from the spirit and broader aspects of the invention as defined in the claims.

The embodiments of the invention in which an exclusive property or privilege is claimed are defined as follows.

We claim:

1. A portable and compact cleaning apparatus comprising:

a housing having a pair of opposite sides and a pair of opposite ends;

a hose having a pick up tool at one of said ends;

a fluid pump in said housing connected by a conduit with said pick up tool for pumping cleaning solution therethrough to said pick up tool for dispensing said solution on a surface to be cleaned;

a cleaning solution supply tank located in said housing and being operably connected in liquid flow communication to said fluid pump;

a vacuum fan in said housing for sucking the cleaning solution and dirt into said tool and through said hose and for discharging the cleaning solution and dirt from an outlet thereof, said hose being connected to a vacuum inlet of said vacuum fan; and a recovery tank removably supported on said housing along one of said sides thereof and juxtaposed with said outlet of said vacuum fan for receiving the sucked up cleaning solution and dirt, said recovery tank being positioned laterally of said vacuum fan and extending substantially between said opposite ends of said housing.

2. The cleaning apparatus of claim 1 further including a receiving well into which said supply tank is removably received.

3. The cleaning apparatus of claim 2 in which said housing further includes a side pocket for releasably holding therein said recovery tank, wherein said recovery tank is capable of being removed from said pocket by sliding said recovery tank out one of said ends of said housing, whereby the received cleaning solution and dirt may be disposed.

4. The cleaning apparatus of claim 1 in which said housing further includes a side pocket for releasably holding therein said recovery tank, wherein said recovery tank is capable of being removed from said pocket by withdrawing said recovery tank out one of said ends of said housing, whereby the received cleaning solution and dirt may be disposed.

5. A portable and compact cleaning apparatus comprising:

a recovery tank;

a housing having a pair of opposite sides, a pair of opposite ends and a side pocket for releasably holding therein said recovery tank, wherein said recovery tank is capable of being removed from said pocket by withdrawing said recovery tank out one of said ends of said housing, whereby the received cleaning solution and dirt may be disposed;

a hose having a pick up tool at one end;

a fluid pump in said housing connected by a conduit with said pick up tool for pumping cleaning solution to said pick up tool for dispensing said solution on a surface to be cleaned;

a cleaning solution supply tank located in said housing and being operably connected to said fluid pump;

a vacuum fan in said housing for sucking the cleaning solution and dirt into said tool and through said hose and for discharging the cleaning solution and dirt from an outlet, said hose being connected to a vacuum inlet of said vacuum fan;

said recovery tank being supported on said housing along one of said sides thereof and juxtaposed with said outlet of said vacuum fan for receiving the sucked up cleaning solution and dirt;

means for stowing said hose on said housing; and wherein said pocket includes a guideway and said recovery tank includes a complementary channel receiving said guideway to guidingly slide said recovery tank in and out of said pocket.

6. The cleaning apparatus of claim 4 in which said recovery tank includes a lateral ridge positioned along the bottom surface thereof and in which said housing includes a complementary upstanding lip adapted to abut said ridge and releasably retain said recovery tank from sliding out of said one end, whereby said recovery tank is capable of being removed from said pocket by lifting said ridge over said lip as said recovery tank is slid out said one end of said housing.

7. The cleaning apparatus of claim 1 further including stowage means for stowing said hose on said housing, said stowage means including at least one recess into which said hose is received and releasably held when not in use.

8. The cleaning apparatus of claim 7 in which said stowage means includes a plurality of said recesses in which said hose is received when not in use such that said hose defines a serpentine path when received in said recesses.

9. A cleaning apparatus comprising:

a cleaning solution supply tank;

a fluid pump connected with said supply tank for pumping cleaning solution from said supply tank;

a pick up tool having means defining a suction opening and a dispensing nozzle;

a hose having a conduit through which a cleaning solution can be passed connecting said fluid pump with said dispensing nozzle for dispensing the solution on a surface to be cleaned and a passageway connected with said suction opening through which the cleaning solution and dirt can be passed for disposal after being sucked from the surface being cleaned;

a vacuum pump having a suction inlet connected with said passageway for sucking the cleaning solution and dirt from a surface being cleaned into and through said passageway, said vacuum pump having an outlet juxtaposed with a recovery tank for receiving sucked-up cleaning solution and dirt;

a valve assembly which is manually operable to open and close said fluid conduit;

a switch which operates to activate and deactivate said fluid pump; and a manually operable control assembly having means for concurrently operating said valve assembly and said switch, whereby the opening of said conduit corresponds with the activation of said fluid pump and the closing of said conduit corresponds with the deactivation of said fluid pump.

10. The cleaning apparatus of claim 9 in which said valve assembly includes a pair of opposed ridges to each side of said conduit, wherein said control assembly operates to move said opposed ridges toward and away from each other to effect the closing and opening of said conduit.

11. The cleaning apparatus of claim 10 in which said control assembly includes a lever pivotally mounted to said pick up tool, and in which said ridges are positioned such that one ridge is fixed to a wall of said pick up tool and the other ridge is attached to said lever for movement toward and away from said one ridge.

12. The cleaning apparatus of claim 11 in which said switch includes at least one contact element mounted to said pick up tool and at least one complementary contact element mounted to said lever for movement therewith between a first position in which said contact elements engage one another to activate said fluid pump and a second position in which said contact elements are disengaged to deactivate said fluid pump.

13. The cleaning apparatus of claim 12 in which said lever includes a medially oriented pivot axis, a first end positioned to one side of said pivot axis having a means for facilitating manual engagement and operation of said lever, and a second end positioned to the other side of said pivot axis, wherein said second end of said lever mounts said other ridge and said complementary contact element.

14. The cleaning apparatus of claim 11 in which said switch includes a pair of spaced apart contacts electrically connected to said fluid pump and mounted to said pick up tool, and a bridging contact element attached to said lever for movement therewith between an activating position wherein said bridge contact element engages said pair of spaced apart contacts and a deactivating position wherein said bridging contact element is disengaged from said spaced apart contacts.

15. A cleaning apparatus comprising:

dispensing means for dispensing a cleaning solution onto a surface to be cleaned;

said dispensing means including a fluid pump and a low voltage motor for driving said fluid pump;

recovery means for recovering the cleaning solution and dirt from the surface being cleaned;

said recovery means including a vacuum fan, a high voltage motor for driving said vacuum fan and coupling means for electrically coupling said high voltage motor to a power supply;

said high voltage motor including a stator winding electrically connected with said coupling means and a separate auxiliary winding, said stator winding and auxiliary winding being cooperatively arranged such that they operate as a transformer to reduce high voltage coupled to said stator winding to low voltage on said auxiliary winding; and means for electrically coupling said auxiliary winding of said high voltage motor with said low voltage motor.

16. The cleaning apparatus of claim 15 in which said high voltage motor is of the type that is powered by alternating current and said low voltage motor is of the type that is powered by direct current, and in which said means for coupling said auxiliary winding to said low voltage motor includes a rectifier to convert the alternating current into direct current.

17. A cleaning apparatus comprising:

(1) a housing having opposite sides and ends and
  (a) a recovery chamber receiving pocket on one side thereof; and
  (b) a cleaning solution dispensing container receiving well located between said opposite sides;
(2) a fluid pump located within said housing adjacent said receiving well;
(3) a vacuum fan located in said housing between said receiving well and one of said ends of said housing, said vacuum fan having an inlet opening through said one of said ends of said housing and an outlet opening toward said receiving pocket at said one side of said housing;
(4) a recovery chamber removably located in said receiving pocket, said recovery chamber having an open top subjacent said outlet of said vacuum fan;
(5) a cleaning solution dispensing container having a dispensing spout and being removably located in said receiving well with said dispensing spout opening downwardly;
(6) a first fluid conduit connected to said spout at one end and being connected to an inlet of said fluid pump at the other end, said first fluid conduit being flexible and sufficiently long to facilitate removal of said dispensing container from said receiving well;
(7) a vacuum hose having a pick up tool on one end thereof and being connected at the other end to said vacuum fan inlet;
(8) a cleaning fluid dispensing conduit extending from an outlet of said fluid pump to said pick up tool; and
(9) means for activating said suction fan and means for activating said fluid pump, whereby fluid is pumped to said pick up tool and applied to a surface to be cleaned, and is then withdrawn from said surface by said vacuum fan and is deposited in said removable recovery chamber.

18. A cleaning apparatus comprising:

(1) a housing having opposite sides and ends and
  (a) a recovery chamber receiving pocket on one side thereof;
  (b) a cleaning solution dispensing container receiving well located between said opposite sides; and
  (c) a vacuum hose storage channel on said other side of said housing, opposite said recovery chamber receiving pocket;
(2) a fluid pump located within said housing adjacent said receiving well;
(3) a vacuum fan located in said housing between said receiving well and one of said ends of said housing, said vacuum fan having an inlet opening through said one of said ends of said housing and an outlet opening toward said receiving pocket at said one side of said housing;
(4) a recovery chamber removably located in said receiving pocket, said recovery chamber having an open top subjacent said outlet of said vacuum fan;
(5) a cleaning solution dispensing container having a dispensing spout and being removably located in said receiving well with said dispensing spout opening downwardly;
(6) a first fluid conduit removably connected to said spout at one end and being connected to an inlet of said fluid pump at the other end;
(7) a vacuum hose having a pick up tool on one end thereof and being connected at the other end to said vacuum fan inlet;
(8) cleaning fluid dispensing conduit extending from an outlet of said fluid pump to said pick up tool; and
(9) means for activating said suction fan and means for activating said fluid pump, whereby fluid is pumped to said pick up tool and applied to a surface to be cleaned, and is then withdrawn from said surface by said vacuum fan and is deposited in said removable recovery chamber.

19. The cleaning apparatus of claim 18 in which said housing includes a top and a handle on said top for convenient maneuverability.

20. The cleaning apparatus of claim 18 in which there are a pair of said hose channels on said other side of said housing, each of said hose channels extending from one end 21. A cleaning apparatus comprising:

(1) a housing having opposite sides and ends and (a) a recovery chamber receiving pocket on one side thereof; and (b) a cleaning solution dispensing container receiving well located between said opposite sides;

(2) a fluid pump located within said housing adjacent said receiving well;

(3) a vacuum fan located in said housing between said receiving well and one of said ends of said housing, said vacuum fan having an inlet opening through said one of said ends of said housing and an outlet opening toward said receiving pocket at said one side of said housing;

(4) a recovery chamber removably located in said receiving pocket, said recovery chamber having an open top subjacent said outlet of said vacuum fan, said recovery chamber including spaced sidewalls and anti-slosh baffles extending inwardly from one of said sidewalls towards but not to the other of said sidewalls;

(5) a cleaning solution dispensing container having a dispensing spout located in said receiving well with said dispensing spout opening downwardly;

(6) a first fluid conduit removably connected to said spout at one end and being connected to an inlet of said fluid pump at the other end;

(7) a vacuum hose having a pick up tool on one end thereof and being connected at the other end to said vacuum fan inlet;

(8) cleaning fluid dispensing conduit extending from an outlet of said fluid pump to said pick up tool; and (9) means for activating said suction fan and means for activating said fluid pump, whereby fluid is pumped to said pick up tool and applied to a surface to be cleaned, and is then withdrawn from said surface by said vacuum fan and is deposited in said removable recovery chamber.

22. The apparatus of claim 21 in which said recovery chamber is approximately as long as said housing and is relatively narrow whereby the profile of said apparatus may be maintained relatively thin.

23. The apparatus of claim 17 in which said recovery chamber is approximately as long as said housing and is relatively narrow whereby the profile of said apparatus may be maintained relatively thin.

24. The apparatus of claim 17 wherein said fluid pump includes a low voltage motor for driving said pump;

said means for activating said pump includes control wires extending from said low voltage motor through the interior of said vacuum hose to said pick up tool;

said pick up tool including a switch for making and breaking contact with said control wires to thereby control the activation of said pump.

25. The apparatus of claim 24 in which said switch is controlled by a control assembly, said control assembly including a valve for opening and closing said cleaning fluid dispensing conduit at said pick up tool concurrently with said switch being controlled.

26. A cleaning apparatus comprising:

(1) a housing having opposite sides and ends and (a) a recovery chamber receiving pocket on one side thereof; and (b) a cleaning solution dispensing container receiving well located between said opposite sides;

(2) a fluid pump located within said housing adjacent said receiving well and including a low voltage motor for driving said pump;

(3) a vacuum fan located in said housing between said receiving well and one of said ends of said housing, said vacuum fan having an inlet opening through said one of said ends of said housing and an outlet opening toward said receiving pocket at said one side of said housing;

(4) a recovery chamber removably located in said receiving pocket, said recovery chamber having an open top subjacent said outlet of said vacuum fan;

(5) a cleaning solution dispensing container having a dispensing spout located in said receiving well with said dispensing spout opening downwardly;

(6) a first fluid conduit removably connected to said spout at one end and being connected to an inlet of said fluid pump at the other end;

(7) a vacuum hose having a pick up tool on one end thereof and being connected at the other end to said vacuum fan inlet;

(8) cleaning fluid dispensing conduit extending from an outlet of said fluid pump to said pick up tool; and (9) means for activating said suction fan and means for activating said fluid pump, whereby fluid is pumped to said pick up tool and applied to a surface to be cleaned, and is then withdrawn from said surface by said vacuum fan and is deposited in said removable recovery chamber, said means for activating said pump including control wires extending from said low voltage motor through the interior of said vacuum hose to said pick up tool, said pick up tool including a switch for making and breaking contact with said control wires to thereby control the activation of said low voltage motor, said switch being controlled by a control assembly, said control assembly including a valve for opening and closing said cleaning fluid dispensing conduit at said pick up tool concurrently with said switch being controlled, wherein said valve includes opposed ridges located to each side of said fluid dispensing conduit and said conduit being sufficiently flexible that it can be pinched closed, and in which said control assembly includes means to move said opposed ridges toward and away from each other to effect closing and opening of said conduit.

27. The cleaning apparatus of claim 26 in which said control assembly includes a lever pivotally mounted to a wall of said pickup tool and in which said ridges are positioned such that one ridge is fixed to said wall and the other ridge is attached to said lever for movement toward and away from said one ridge.

28. The cleaning apparatus of claim 27 in which said switch includes at least one contact element mounted to said wall and at least one complementary contact element mounted to said lever for movement therewith between a first position in which said contact elements engage one another to activate said fluid pump and a second position in which said contact elements are disengaged to deactivate said fluid pump.

29. A cleaning apparatus comprising:

(1) a housing having opposite sides and ends and (a) a recovery chamber receiving pocket on one side thereof; and (b) a cleaning solution dispensing container receiving well located between said opposite sides;

(2) a fluid pump located within said housing adjacent said receiving well and including a low voltage motor for driving said pump;

(3) a vacuum fan located in said housing between said receiving well and one of said ends of said housing, said vacuum fan having an inlet opening through said one of said ends of said housing and an outlet opening toward said receiving pocket at said one side of said housing;

(4) a recovery chamber removably located in said receiving pocket, said recovery chamber having an open top subjacent said outlet of said vacuum fan;

(5) a cleaning solution dispensing container having a dispensing spout located in said receiving well with said dispensing spout opening downwardly;

(6) a first fluid conduit removably connected to said spout at one end and being connected to an inlet of said fluid pump at the other end;

(7) a vacuum hose having a pick up tool on one end thereof and being connected at the other end to said vacuum fan inlet;

(8) cleaning fluid dispensing conduit extending from an outlet of said fluid pump to said pick up tool; and (9) means for activating said suction fan and means for activating said fluid pump, whereby fluid is pumped to said pick up tool and applied to a surface to be cleaned, and is then withdrawn from said surface by said vacuum fan and is deposited in said removable recovery chamber;

(10) wherein said fluid pump includes a low voltage motor driving said pump and said vacuum fan includes a high voltage motor for driving said vacuum fan and means for electrically coupling said high voltage motor to a power supply, said high voltage motor including a stator winding and separate auxiliary winding, said stator and auxiliary windings being cooperatively arranged such that they operate as a transformer to reduce high voltage coupled to said stator winding to low voltage on said auxiliary winding; and said apparatus further including means for electrically coupling said auxiliary winding of said high voltage motor with said low voltage motor.

30. The cleaning apparatus of claim 29 in which said high voltage motor is of the type that is powered by alternating current and said low voltage pump is of the type that is powered by direct current, and in which said means for coupling said auxiliary windings to said low voltage motor includes a rectifier to convert the alternating current into direct current.

31. A cleaning apparatus comprising:

(1) a housing having a pair of opposite sides, a pair of opposite ends and a recovery chamber receiving pocket extending between said opposite ends along one of said sides;

(2) a fluid pump located within said housing;

(3) a vacuum fan located in said housing, said vacuum fan having an inlet opening through one of said ends and an outlet opening toward said receiving pocket;

(4) a recovery chamber removably located in said receiving pocket and extending substantially between said opposite ends, said recovery chamber being located laterally of said vacuum fan and having an open top subjacent said outlet of said vacuum fan;

(5) a cleaning solution dispensing container operably connected to said fluid pump;

(6) a vacuum hose having a pick up tool on one end thereof and being connected at the other end to said vacuum fan inlet;

(7) cleaning fluid dispensing conduit extending from said fluid pump to said pick up tool; and (8) means for activating said suction fan and means for activating said fluid pump, whereby fluid is pumped to said pick up tool and applied to a surface to be cleaned, and is then withdrawn from said surface by said vacuum fan and is deposited in said removable recovery chamber.

* * * * *

UNITED STATES PATENT AND TRADEMARK OFFICE

CERTIFICATE OF CORRECTION

PATENT NO. : 4,910,828

DATED : March 27, 1990

INVENTOR(S) : Michael R. Blase et al.

It is certified that error appears in the above-identified patent and that said Letters Patent is hereby corrected as shown below:

Column 13, Line 2:

After "one end" insert --of said housing to the other whereby said vacuum hose can be conveniently stored by locating a first portion in one of said channels and bending it around and locating the second portion in the second of said channels."

Signed and Sealed this

Seventeenth Day of March, 1992

*Attest:*

HARRY F. MANBECK, JR.

*Attesting Officer*

*Commissioner of Patents and Trademarks*